United States Patent [19]

Gisler et al.

[11] Patent Number: 4,685,228

[45] Date of Patent: Aug. 11, 1987

[54] SNOW-REMOVING MACHINE

[75] Inventors: Hans Gisler, Bern; Marcel Boschung, Schmitten, both of Switzerland

[73] Assignee: Reberle reg. Treuunternehmen Schaan, Schaan, Liechtenstein

[21] Appl. No.: 820,264

[22] Filed: Jan. 17, 1986

[30] Foreign Application Priority Data

Jan. 23, 1985 [CH] Switzerland ..... 297/85

[51] Int. Cl.[4] ..... E01H 5/00; E01H 1/02

[52] U.S. Cl. ..... 37/197; 37/233; 15/78; 15/82

[58] Field of Search ..... 37/232, 233, 234, 236, 37/244, 197; 15/55, 78, 82–87

[56] References Cited

U.S. PATENT DOCUMENTS 1,560,612 11/1925 Sims ..... 37/232

2,516,600 7/1950 Shipley et al. ..... 37/232

*Primary Examiner*—E. H. Eickholt

*Attorney, Agent, or Firm*—Dann, Dorfman, Herrell & Skillman

[57] ABSTRACT

The sweeping brush of the machine is composed of two or more parts in order to maintain a constant pressure of the sweeping brush against the ground, to achieve faster clearance of the snow, and to avoid downtime for adjustments. These brush parts are swivellable relative to one another in a vertical plane. The common raising and lowering movement of the individual parts is controlled by a cylinder-piston unit, and the piston acting upon the brush parts is always impinged upon by a pressure opposite to the direction of movement. The individual brush parts may be connected to one another by torsion bars.

5 Claims, 12 Drawing Figures

Figure 3:
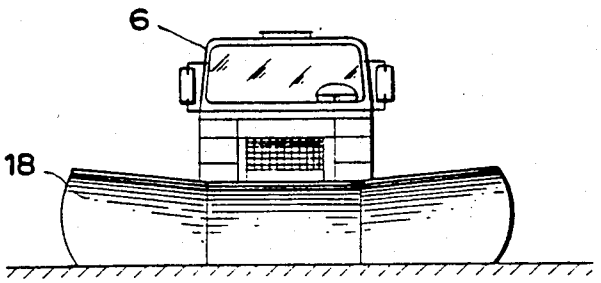

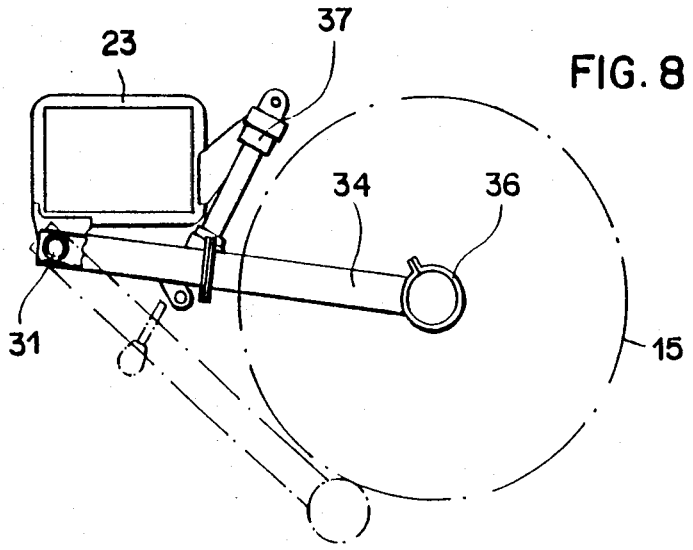
FIG. 8
FIG. 9
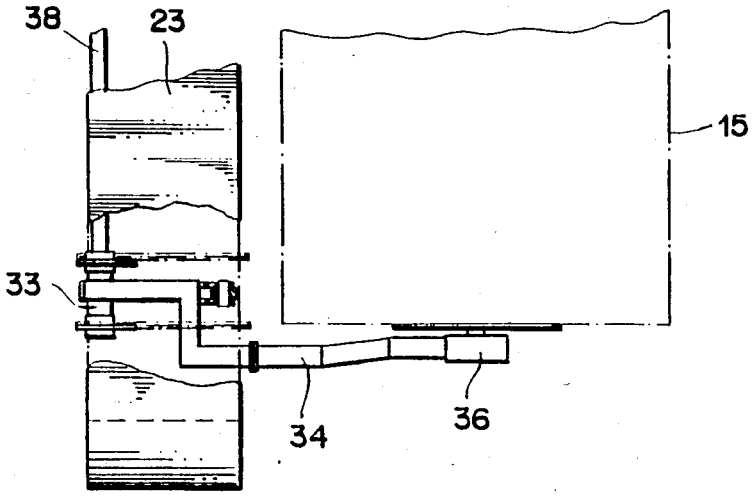

| | $Y_1$ | $Y_2$ | $Y_3$ |
|---|---|---|---|
| — | 0 | 0 | 0 |
| ↓ | 0 | 1 | 1 |
| ↑ | 1 | 0 | 0 |

$P_0 > P_2 > P_1$

SNOW-REMOVING MACHINE

This invention relates to snow-clearance equipment, more particularly to a snow-removing machine of the type having a raisable and lowerable sweeping brush, as well as to a method of operating such a machine.

There are three main requirements for snow-removing machines of this type, viz., thoroughness in clearing the surface to be treated, high clearing speed, and no interruptions during operation for resetting the pressure against the ground.

These requirements are related insofar as snow-removing machines having multi-art sweeping brushes are fundamentally quite capable of sufficiently thorough clearing but tend to shimmy to a greater extent owing to a certain independence of the brush portions. This follows from the very fact that the brush portions are pivotable relative to one another in a vertical plane in order to be able to adapt better to the configuration of the surface to be cleared; however, precisely this adapting motion leads to the aforementioned partial independence of the brush portions.

To avoid the resultant drawbacks, two groups of designs have been proposed. One provides for a fixed, i.e., springless, suspension of the sweeping brush in a frame supported by a roller resting on the ground, whereas the other represents an attempt to eliminate the effect of reduction of the sweeping brush diameter by means of a pneumatic control or pneumatically-controlled lowering. With the first group, it is not possible to avoid periodic down-time for readjustment of the brush arrangement nor limitations on the rate of removal caused by the roller, which unfailingly begins to bounce when it encounters rough ground. This latter shortcoming, preventing a satisfactory rate of removal, cannot be avoided with prior art machines of the second group, either; for the lowering movement, being undamped, again leads to shimmying of the sweeping brush.

It is an object of this invention to provide an improved snow-removing machine permitting more thorough clearance of the snow, increased clearing speed, and uninterrupted operation, by overcoming the aforementioned problems.

A further object of this invention is to provide a particularly advantageous method of operating a snow-removing machine.

To this end, in the snow-removing machine according to the present invention, of the type intially mentioned, the improvement comprises a sweeping brush formed of a plurality of portions, the common raising and lowering movement of the individual sweeping brush portions, which are pivotable relative to one another in a vertical plane, being controlled by cylinder-piston units, and the piston acting upon the sweeping brush portions always being impinged upon by pressure opposite to the direction of movement.

In a particularly advantageous embodiment to be described below, a torsion bar connecting the various sweeping brush portions is provided as a further damping means.

In the method of operation according to the present invention, the pistons of the cylinder-piston units are impinged upon at the points of application of the cylinder-piston units by differing pressures corresponding to the differing weights of the sweeping brush portions for the purpose of raising the sweeping brush portions, and on the opposite side of the pistons a counterpressure corresponding to the desired pressure on the ground is caused to act for the purpose of lowering the sweeping brush portions.

Figure 4:
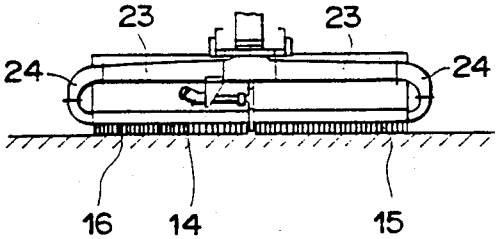
Figure 1:
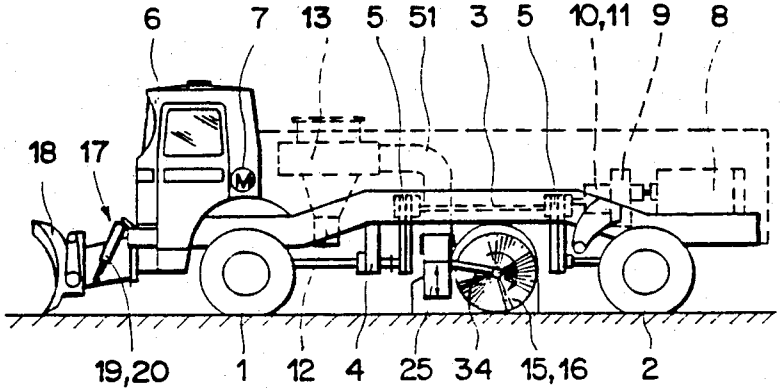
Figure 2:
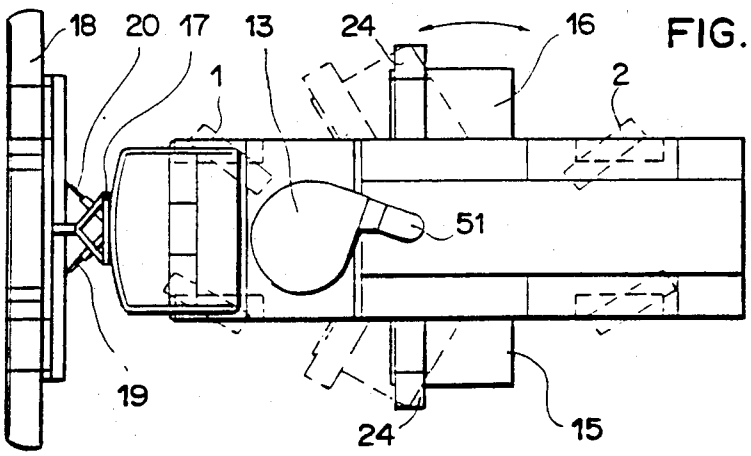
Figure 5:
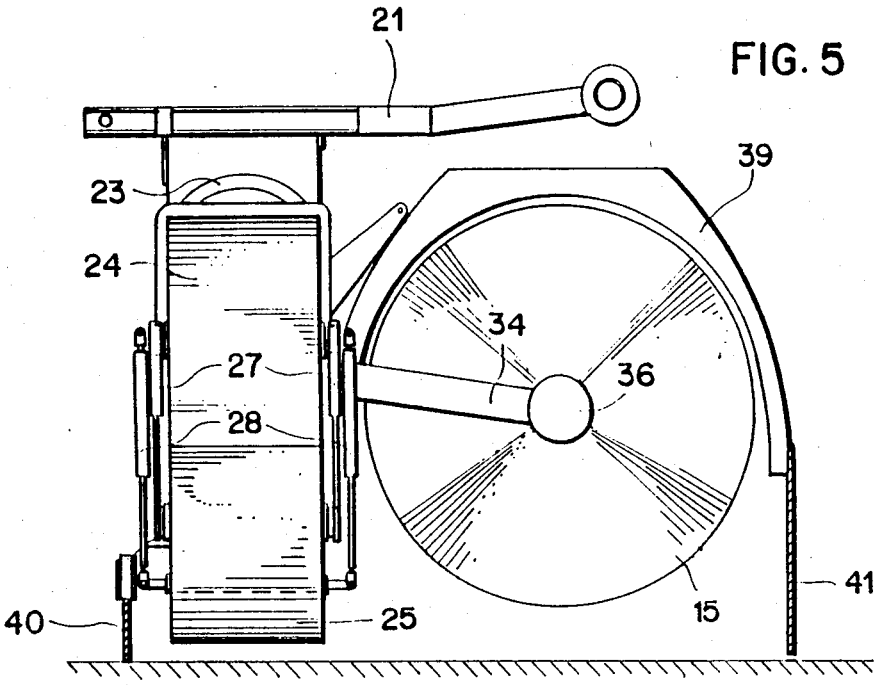
Figure 6:
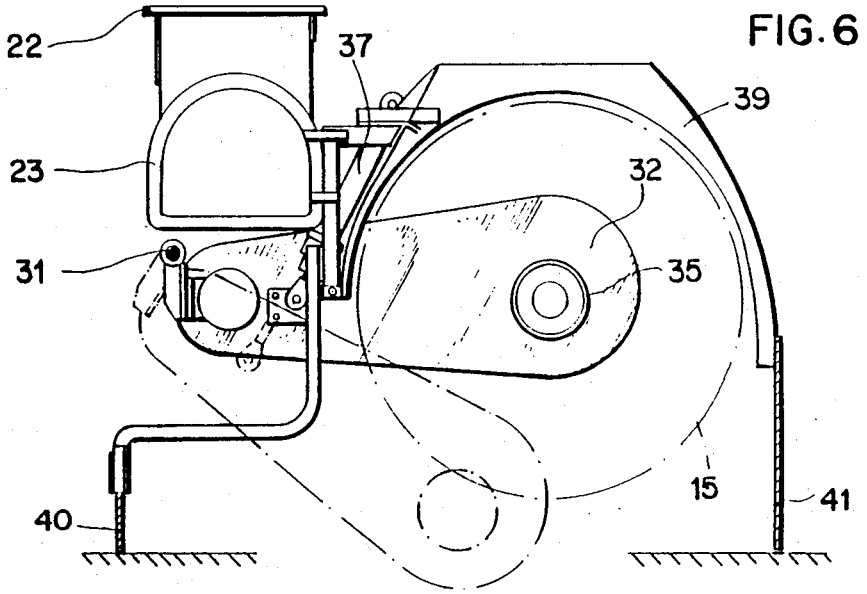
Figure 7:
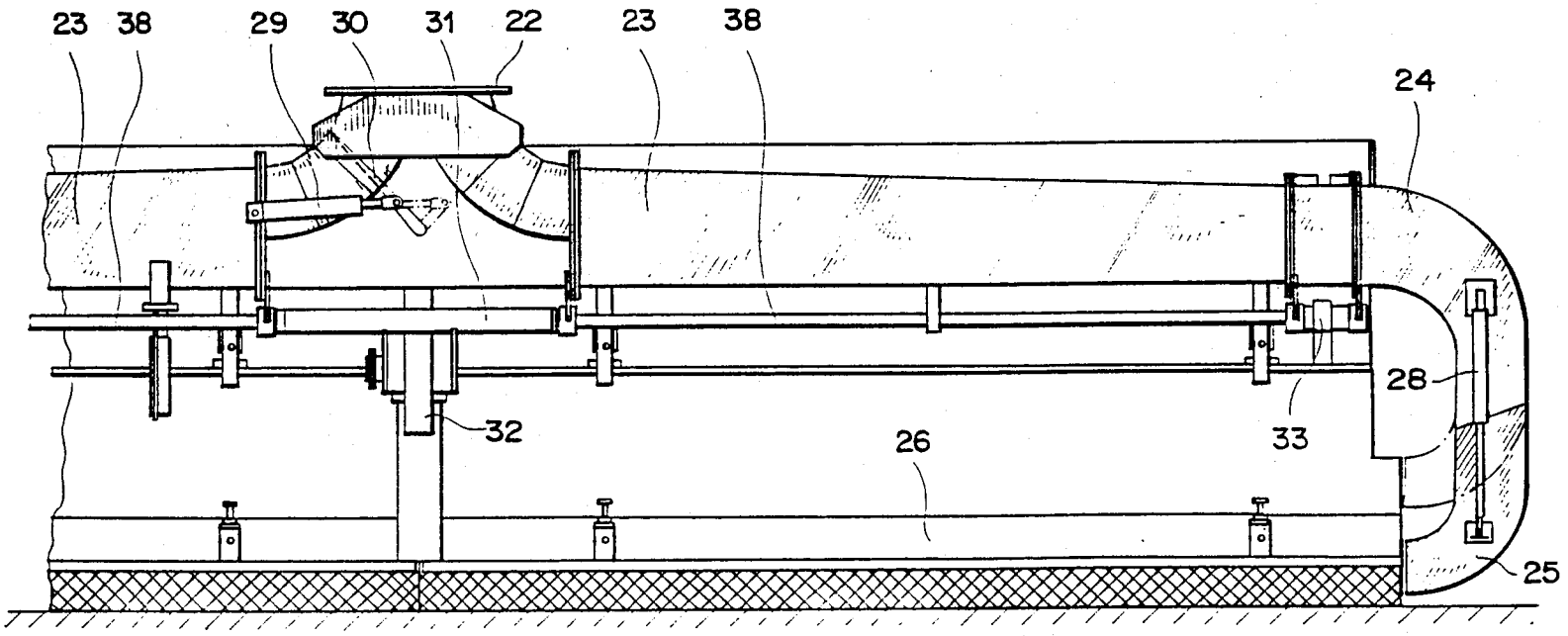
Figure 10:
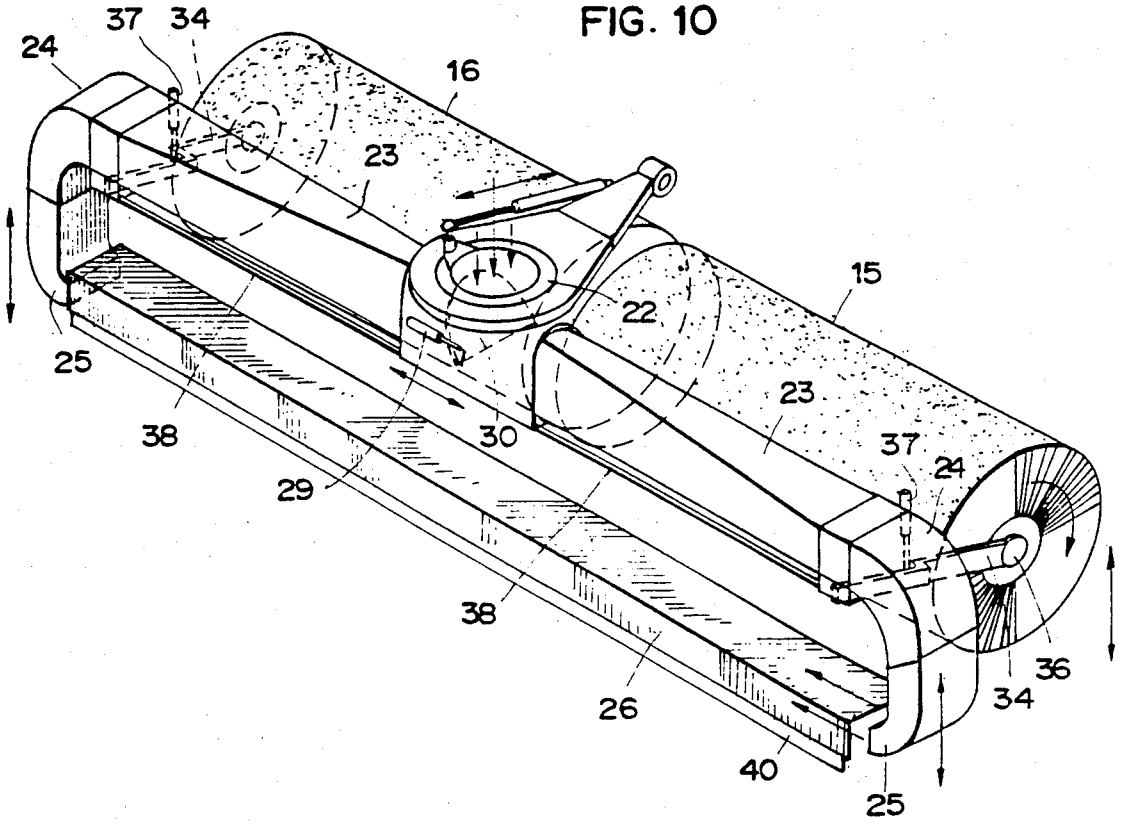
Figures 11, 12:
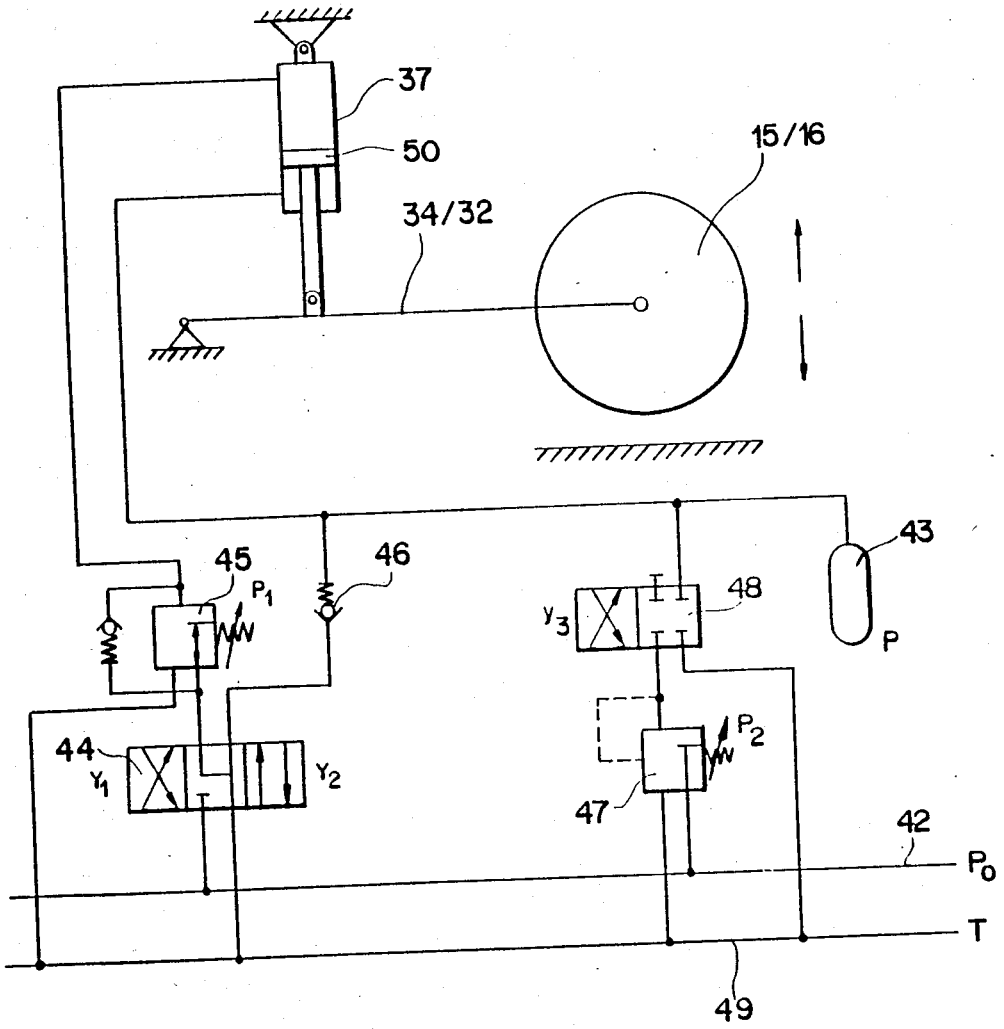

A preferred embodiment of the invention will now be described in detail with reference to the accompanying drawings, in which:

FIGS. 1–3 are a side elevation, a top plan view, and an end-on view of a snow-removing machine, FIG. 4 is a front elevation of a blower-sweeper unit, FIG. 5 is a side elevation of the blower-sweeper showing means for suspending the unit from a carrier vehicle, an outer arm for holding the sweeping brush, and a nozzle, adjustable in height, at the end of an air duct, FIG. 6 is the same side elevation as FIG. 5 viewed directly before the middle of the unit, showing a middle brush suspension and drive, as well as a hydraulic lifting device, FIG. 7 is a partial front elevation of the blower-sweeper showing air deflection means at the entrance to the air duct, a torsion-bar connection between the hydraulic lifting devices, and the vertically adjustable air nozzle with retractile spring, FIGS. 8 and 9 are a side elevation and a top plan view, respectively, of the outer holding and lifting device for the sweeping brush, FIG. 10 is a perspective view of the sweeping brush and the blower, FIG. 11 is a diagram of the control system, and FIG. 12 is an operation table.

The carrier vehicle illustrated in FIGS. 1 and 2 has a conventional steered front planetary axle 1 and a likewise steerable rear planetary axle 2 which is locked, i.e., disengaged, in mid-position but can be engaged at any time. The engaging mechanism is so designed that depending upon the position of a control valve (not shown) in a cab 6, it is possible to shift to front-wheel steering, all-wheel steering, or crab steering. With all-wheel steering, the rear axle exactly follows the alignment of the front axle and thus compels the blower-sweeper to keep in the track of the vehicle even during cornering. When the driver shifts to crab steering, all four wheels are steered in the same direction, which leads to diagonal displacement of the entire vehicle. Obstacles can thus be avoided, and maneuvering is facilitated.

The chassis of the vehicle is designed as an inverted "U" chassis 3, so that in the region between front and rear axles 1 and 2, as high a clearance as possible is created between the chassis and the roadway. The mechanical drive of rear axle 2 is transmitted to the latter from a distributor gear 4 via front and rear angular transfer gears 5.

Disposed in the area beneath cab 6 is a traction engine 7 followed by a multi-step automatic transmission from which the drive is transmitted to distributor gear 4 and thence to front and rear axles 1 and 2. Distributor gear 4 and axles 1 and 2 have differential gear equalization with switch-in brakes. The multi-step automatic transmission allows graduated working speeds, it being left to the driver to select a maximum speed, and also allows speeds of up to 80 kph for travelling to a new location. Disposed in the region above rear axle 2 is a working engine 8 which drives as necessary, via a distributor gear 9, two, or if need be more, hydraulic swivel piston pumps 10 and 11 with zero adjustment oil control, which in turn transmit the force via an axial-stroke pump 12 to a high-output radial-flow blower 13 and to a centrally disposed sweeping brush drive 14. The speeds of rotation of blower 13 and of sweeping brush portions 15, 16 can be varied independently of one another, as need be, from a standstill up to a predetermined maximum speed of rotation and thus adapted to the prevailing conditions. These speeds of rotation are detected by pick-ups (not shown) and continuously indicated in cab 6.

Disposed on a quick-change device 17 at the front of the vehicle is a snowplow 18 which can be raised, lowered, and swivelled to the left and right about a vertical axis by means of hydraulic lifting elements 19 and 20. An elevation of snowplow 18 is shown in FIG. 3.

Chassis 3 and the body (omitted in FIG. 2) of the vehicle are designed so that any desired superstructural parts, e.g., a container for sweepings, a water tank, mowing equipment, etc., for other types of work, may be disposed over the entire space extending from behind cab 6 to the end of the vehicle.

In the region of chassis 3, all the necessary equipment of a modern vehicle is conveniently disposed, such as electric power supply, compressed air tanks, hydraulic auxiliary pumps for operating and steering apparatus, fuel tanks, and all hydraulic units for operating and controlling the tools and implements.

To ensure optimum driving characteristics, the vehicle is naturally equipped with parabolic springs on the front and rear axles, shock absorbers and transverse stabilizers, as well as a dual-circuit compressed-air power-braking system and spring-actuated parking brakes on all wheels.

The overall length of the vehicle, including the snowplow mounted at the front, is only about 10 m. With this compact construction, an outer turning radius of about 20 m. is possible with front-wheel steering, and about 12 m. when the all-wheel steering is engaged.

Snowplow 18 may be any of the usual commercially-available snowplows.

Turning now to FIGS. 4, 5, and 6 illustrating the blower-sweeper unit, it will be seen from FIG. 6 that a ball-bearing ring mounting 22 is disposed in a three-point suspension 21 intended to be secured to chassis 3. Fitted on the underside of mounting 22 is an air-supply pipe 23 designed as a bearing structure. Pipe 23 leads from the middle of the unit to the lateral ends left and right. The air is conveyed by the turbine (radial-flow blower 13, FIGS. 1 and 2) via a pipe 51 through mounting 22, a bent pipe 24, and a nozzle 25 to an air duct 26 (FIG. 7) disposed in front of sweeping brush 15/16. Nozzle 25 is adjustable in height by means of guide rails 27 and retractile springs (gas-pressure springs) 28 and can thus be moved in proximity to air duct 26 or else above that duct. The entire adjustment, and particularly the force of retractile springs 28, is such that upon admission of an appropriate amount of air, nozzle 25 is automatically moved by the resultant build-up of pressure into the lower operating position and, when the supply of air is interrupted, by springs 28 into the upper resting position.

As shown in FIG. 7, an air baffle 30 can be moved by means of a hydraulic cylinder 29 into a left-hand end position indicated in solid lines or a right-hand end position shown in dot-dash lines, thus deflecting the air supply from the turbine to air nozzle 25 either to the right or to the left. By means of another hydraulic cylinder (not shown), linked at one end to mounting 22 and at the other end to chassis 3, air duct 26 and sweeping brush 15/16 connected thereto can be moved at will about the vertical pivot point of ring mounting 22 into an operating position, shown in FIG. 2, to the left or to the right, or into any desired intermediate position.

An outer holding and lifting device for the sweeping brush is depicted in FIGS. 8 and 9. Disposed on a pivot bearing 31 situated below air-supply pipe 23, in the middle of the unit, is an endless chain drive 32 (FIG. 7), while lifting and holding arms 34 are rotatingly disposed on outer pivot points 33.

The sweeping brush composed of brush portions 15 and 16 is mounted to rotate freely in outer bearings 36 while being rotatingly integral with an arcuate spline-shaft section 35 (FIG. 6) projecting to the left and right from chain drive 32. Sweeping brush 15/16 is raised into its travelling position and lowered into its operating position, where it is held with a constant pressure against the ground, by means of two double-acting hydraulic cylinders mounted between the sides of chain drive 32 and supports on pipe 23, and by two further double-acting hydraulic cylinders 37 mounted at the ends of pipe 23 between arms 34 and supports on pipe 23 (cf. FIG. 10).

Two torsion bars 38 (or only one) connecting pivot points 31 and 33 are provided for stabilizing and mutually supporting the lifting devices disposed at pivot points 31 and 33 but are so dimensioned that chain drive 32, serving as the middle lifting device, and the outer lifting and holding arms 34, may be independent of one another within a certain angular range and thereby enable optimum adaptation of brush portions 15/16 to the surface to be cleared, even when there are substantial irregularities and slopes or cambers. The aforementioned constant pressure of brush portions 15/16 against the ground is ensured by means of the hydraulic system diagrammed in FIG. 11, comprising a hydraulic pump, an overpressure valve, control valves, and the four hydraulic cylinders 37; this system causes the sweeping brush to rest as uniformly as possible upon the ground, resulting in optimum snow clearance with a minimum of wear and tear and allowing substantially greater clearance speeds. By means of the fixed arrangement of the entire air-supply duct with a brush cover 39 (FIGS. 5 and 6), designed as a bearing element, the remaining overall mass can be kept as low as possible, thereby also contributing toward stabilization and toward smooth functioning of sweeping brush portions 15 and 16.

As will be apparent from FIG. 10, assembly and disassembly of the sweeping brush, and hence replacement of the individual portions, is facilitated by its division into two segments. Brush portions 15/16 may consist of disk- or strip-shaped brush segments, of steel wire or plastic.

Two-part sweeping brush 15/16 is hinged at three points and, in principle, suspended from three lever arms moved by means of differential hydraulic cylinders 37 with pistons 50.

Chain drive 32, with two cylinders 37, takes care of the middle suspension, independently of the two outer suspensions 34, which operate with one cylinder each and are connected in parallel.

By means of this arrangement with separate hydraulic circuits having different, adjustable pressures, the differing suspension reactions between the middle and the outside can be separately equalized through the weights of the rotary brushes and the chain drive. This weight compensation makes possible optimum adaptation of the two brushes to the ground and ensures that they wear down evenly.

With working engine 8 running, radial-flow blower 13 and sweeping brush portions 15 and 16 are set in rotation by hydraulic oil motor 10 and 11.

As already mentioned, the air supplied by blower 13 is conveyed to the left-hand or right-hand nozzle 25, depending upon the position of air baffle 30. Owing to the pressure build-up of the air supplied, nozzle 25 is pushed down into its operating position against the bias of retractile spring 28 and rises into its resting position again when the air supply is interrupted. (This movement may be brought about hydraulically instead by substituting a hydraulic cylinder for spring 28 and connecting it in series with cylinder 29, for example. The appropriate right or left nozzle 25 would then automatically be lowered or raised upon reversal of air baffle 30.)

The snow or dirt thrown up within range of air duct 26 by brush portions 15/16 is caught in duct 26 by the rushing stream of air from nozzle 25 and blown out laterally to the left or right. By means of this air-flow arrangement disposed in front of the sweeping brush, the snow or dirt is not freely whirled up but is deflected in flight and blown out laterally, though the brush may be turned slightly at an angle, or even when it is at right angles to the direction of travel. Protective rubber flaps 40 and 41 (FIGS. 5, 6 and 10) bound the operating area of the blower-sweeper unit at the front and rear.

Working engine 8 and the working implements (snowplow and blower-sweeper unit) are operated and monitored electrically or electro-hydraulically from an additional operating panel in the cab. The simple arrangement and the type of drive used, with automatic transmission, enable the driver to handle the machine easily without another operator. The hydraulic drives of the radial turbine and the sweeping brushes are secured against overloading by the zero adjustment oil control of the swivel piston pumps.

The mechanical attachment of the entire blower-sweeper unit by means of three-point suspension 21 and the hydraulic connections for the brush drive and for actuation of the hydraulic cylinders are laid out in such a way that they can be affixed to the carrier vehicle and dismantled easily and within a relatively short time. The entire blower-sweeper unit rests on the ground by means of four auxiliary wheels having vertically adjustable shafts, and it can be pulled out from under the vehicle laterally.

Referring now to FIGS. 11 and 12, and assuming for the sake of simplicity that the hydraulic brush suspension is reduced to just one cylinder, the means for keeping a constant pressure against the ground function as follows:

Neutal position

Cylinder 37 is locked when directional control valves 44 and 48 are closed.

Lowering

Oil at a pressure $P_0$ is supplied by a pump (not shown) over a pressure line 42 to control valve 44, where the slide opens the passage Y2. The oil then flows through a pressure-reducing valve 45 and, with the pressure adjusted to $P_1$, moves piston 50 of cylinder 37 downward. The oil forced into the other chamber flows against the resistance $P_2$ of a pressure-reducing valve 47 through the passage Y3 and over a return line 49 to a tank (not shown) T.

Parallel thereto, via pressure-reducing valve 47 and passage Y3 of control valve 48, the flow of oil from the pump also keeps the adjusted counterpressure $P_2$ constant in the lower chamber of cylinder 37. A hydraulic pressure basin 43 is incorporated as an additional damping element and ensures the displacement and feed of the oil upon rapid movements of piston 50 in cylinder 37 even when the output of the pump is relatively low.

Through actuation of adjustable pressure-reducing valve 45, the desired pressure $P_1$ against the ground can be set as required.

Raising

Passage Y1 of control valve 44 is open. The oil at pressure $P_0$ flows via check valve 46 into cylinder 37. The displaced oil flows back into tank T via control valve 44. Control valve 48 remains closed.

In this way, a snow-removing machine is provided which ensures faultless snow clearance and, above all, a substantially increased rate of removal as compared with prior art machines, as well as steadily maintaining the desired pressure of the sweeping brush against the ground.

What is claimed is:

1. A snow-removing machine comprising:

a raisable and lowerable sweeping brush formed of a plurality of individual sweeping brush portions and means mounting said brushes for pivotal movement relative to one another in a vertical plane, a plurality of cylinder-piston units, a separate unit controlling the raising and lowering movement of each of said individual sweeping brush portions, common means to supply pressure fluid to all of said units to actuate all of said units to raise and lower said plurality of brush portions, and counterpressure means in each of said plurality of units for causing the piston of said cylinder-piston unit to be impinged upon by pressure opposing the raising and lowering of the unit by said pressure fluid.

2. The snow-removing machine of claim 1, wherein said counterpressure means includes at least one torsion bar extending between and interconnecting said sweeping brush portions.

3. A snow-removing machine according to claim 1, wherein each unit comprises a double-acting two-ended cylinder-piston device, and control means selectively operable to apply said pressure fluid to a selected one of said two ends, and wherein further when said control means is operable for raising said individual brush portion, said counterpressure means includes link means to apply the weight of said brush portion to said piston, and when said control means is operable for lowering said individual brush portion, said counterpressure means comprises means to apply pressure fluid to the end of said unit opposite to the selected end to produce a counterpressure which is reduced by the weight of said brush portion applied by said link means.

4. A snow-removing machine according to claim 3 including a pressure reservoir connected to all of said units to provide a counterpressure in an end of the cylinder so as to be operable to oppose the weight of the brush portion.

5. A method of operating a snow-removing machine having a raisable and lowerable sweeping brush formed of a plurality of individual sweeping brush portions pivotable relative to one another in a vertical plane to engage the ground, a plurality of double-acting cylinder-piston units, a separate unit controlling the raising and lowering movement of each of said individual sweeping brush portions, common means to supply pressure fluid to all of said units to actuate all of said units to raise and lower said plurality of brush portions, and counterpressure means in each of said plurality of units for causing the piston of said cylinder-piston unit to be impinged upon by pressure opposing the actuation of the unit by said pressure fluid, comprising the steps of:

when raising the portion, adjusting the pressure of the pressure fluid supply in each unit to apply to the piston of the cylinder-piston unit a pressure corresponding to the weight of the individual sweeping brush portion in the direction for raising the sweeping brush portion, and when lowering the portion, applying pressure fluid from the common means to one side of the piston in the cylinder-piston unit for lowering each portion, and applying to the opposite side of the piston a pressure fluid providing a counterpressure corresponding to the weight of the individual brush portion so that the pressure fluid applied for the purpose of lowering the sweeping brush portions provides the desired pressure on the ground.

* * * * *